United States Patent [19]

Berdahl

[11] Patent Number: 4,586,350

[45] Date of Patent: May 6, 1986

[54] SELECTIVE RADIATIVE COOLING WITH MGO AND/OR LIF LAYERS

[75] Inventor: Paul H. Berdahl, Oakland, Calif.

[73] Assignee: The United States of America as represented by the United States Department of Energy, Washington, D.C.

[21] Appl. No.: 650,593

[22] Filed: Sep. 14, 1984

[51] Int. Cl.[4] ..... F25B 21/02

[52] U.S. Cl. ..... 62/467; 62/264; 350/1.7

[58] Field of Search ..... 62/264, 467; 126/417; 350/1.7

[56] References Cited

U.S. PATENT DOCUMENTS

| | | | |
|---|---|---|---|
| 3,043,112 | 7/1962 | Head | 62/467 |
| 3,310,102 | 3/1967 | Trombe | 62/467 |
| 3,671,286 | 6/1972 | Fischell | 117/333 |
| 4,147,040 | 4/1979 | Altman | 62/467 |
| 4,150,552 | 4/1979 | Altman | 62/467 |
| 4,155,226 | 5/1979 | Altman | 62/467 |
| 4,199,218 | 4/1980 | Steinhage et al. | 350/1.7 |
| 4,323,619 | 4/1982 | Silvestrini et al. | 428/212 |
| 4,337,990 | 7/1982 | Fan et al. | 350/1.7 |

OTHER PUBLICATIONS

Granqvist et al: "Radiative Cooling to Low Temperatures: General Considerations and Application to Selectively Emitting SiO Films", J. Appl. Physics, 52(6) pp. 4205–4220, Jun. 1981.

Eriksson et al: "Infared Optical Properties of Electron-Beam Evaporated Silicon Oxynitride Films", Applied Optics, vol. 22, No. 20, Oct. 15, 1983.

Turner et al: "Enhanced Reflectance of Reststrahlen Reflection Filters", *Applied Optics,* 8/1965, vol. 4, No. 8, pp. 927–928.

Catalanotti et al: "Radiative Cooling of Selective Surfaces", *Solar Energy,* 1975, vol. 17, pp. 83–89.

Michelle: "Selective Radiation Cooling Another Look", CSIRO Div. of Tribophysics, Univ. of Melbourne, Parkville, Victoria, Australia, Sep. 1976.

*Primary Examiner*—Ronald C. Capossela

*Attorney, Agent, or Firm*—L. E. Carnahan; Roger S. Gaither; Judson R. Hightower

[57] ABSTRACT

A material for a wavelength-selective radiative cooling system, the material comprising an infrared-reflective substrate coated with magnesium oxide and/or lithium fluoride in a polycrystalline form. The material is non-absorptive for short wavelengths, absorptive from 8 to 13 microns, and reflective at longer wavelengths. The infrared-reflective substrate inhibits absorption at wavelengths shorter than 8 microns, and the magnesium oxide and/or lithium fluoride layers reflect radiation at wavelengths longer than 13 microns.

21 Claims, 2 Drawing Figures

SELECTIVE RADIATIVE COOLING WITH MGO AND/OR LIF LAYERS

The invention described herein arose in the course of, or under, Contract No. DE-AC03-76SF00098 awarded by the U.S. Department of Energy.

BACKGROUND OF THE INVENTION

The invention relates to means for producing cooling by thermal radiative transfer, particularly to a material utilized in a wavelength-selective radiative cooling system, and more particularly to such a material comprising an infrared-reflective substrate coated with magnesium oxide in a ceramic form and/or lithium fluoride in a polycrystalline form.

A well known principle of physics is that a good absorber of electromagnetic radiation is also a good radiator, and the net amount of power that is radiated depends on the difference between the temperature of the radiating body and the temperature of its surroundings. It is also recognized that there are no atomic or molecular resonances in the air to absorb radiation in the wavelength range between 8–13 microns. Therefore, a selectively emitting body radiating only in that range, exposed to the clear sky, looks through the "window" in the atmosphere and "sees" a very low temperature. It follows that low temperatures can be reached, if other heat gains are small. In contrast, ordinary spectrally non-selective emitters receive "warm" radiation from the atmosphere in the spectral ranges 5 to 8 and 13 to 40 microns. The attainment of low temperatures is precluded by the absorption of this radiation. In a clear dry climate, either a selective or non-selective radiator can produce about 135 $Wm^{-2}$ of cooling at air temperature. In this case, an ordinary non-selective radiator can (theoretically) cool to about 22° C. below air temperature; an ideal selective radiator can cool to 53° C. below air temperature (based on measured 8 to 13 micron sky radiances).

The basic idea of a thermally selective radiator is to permit transfer of thermal infrared radiation (5 to 40 microns) only in that part of the spectrum which corresponds to the 8–13 micron transparency "window" of the atmosphere (through which cold space can be seen), while preventing transfer in the rest of the spectrum. For radiator temperatures below ambient, such selective radiators which are exposed to the sky can produce more cooling than an infrared-black radiator which cannot reject the "warm" radiation in the spectral bands 5–8 and 13–40 microns.

A thermally selective radiator is generally composed of an infrared-reflective substrate, such as a metal film, coated with a material which has a large infrared absorption in the band (8–13 microns) and little absorption elsewhere. Materials which have been previously suggested for the spectrally selective coatings are Tedlar, a plastic made by DuPont; TPX, a plastic made by Mitsui Petrochemical Industries LTD; silicon monoxide silicon oxynitride; aluminum oxide; and magnesium oxide.

Various approaches have been directed to selective radiation cooling and materials therefor. These prior efforts are exemplified by U.S. Pat. Nos. 3,043,112 issued July 10, 1962 to A. K. Head; 3,310,102 issued Mar. 21, 1967 to F. Trombe; 3,671,286 issued June 20, 1972 to R. F. Fischell; 4,147,040 issued April 3, 1979 to G. Altman; and 4,323,619 issued April 6, 1982 to V. Silvestrini et al. Also, the following articles illustrate prior efforts in this field: "Perspectives Sur L'utilisation Des Rayonnements Solaries Et Terrestres Dans Centain Regions du Monde", F. Trombe, *Rev. Gen. Thermique* 6, 1285–1314, 1967; The Radiative Cooling of Selective Surfaces, S. Catalanotti et al, *Solar Energy*, Vol. 17, pp 83–89, 1975; Selective Radiation Cooling "Another Look", D. Michell, CSIRO Division of Tribophysics, University of Melbourne, Parkville, Victoria, Australia, September 1976; Radiative Cooling To Low Temperatures: General Considerations And Application To Selectively Emitting SiO Films, C. G. Granqvist et al, *J. Appl. Phys.* 52, 4205–4220, 1981; and "Infrared Optical Properties Of Electron-Beam Evaporated Silicon Oxynitride Films", *Applied Optics* 22, 3204–3206, 1983.

One of the problems with the materials primarily utilized in the prior known selective radiation cooling efforts is that these materials absorb some radiation at wavelengths outside the 8 to 13 micron band.

The above-referenced patent to Trombe disclosed magnesium oxide (along with other white pigments: CaO, $CO_3Ca$, $TiO_2$, $ZnO_2$) as a radiator material, without reference to its potential 8 to 13 micron selectivity. (In Trombe's patent the word "selective" is often used to denote materials which are white in the solar spectrum, 0.3 to 3 microns, and black in the thermal spectrum, 5 to 40 microns; whereas, the word "selective" is used herein to denote materials which are black between 8 and 13 microns and white outside this range.) However, the subsequent above-referenced paper by Trombe recognizes the potential for 8–13 micron selective cooling by the use of MgO in the form of single crystals. A need has existed in the art for materials not in the form of single crystals which can be effectively utilized in selective radiation cooling systems, and particularly such materials that are reflective in the 13–40 micron wavelength range.

Therefore, it is an object of this invention to provide a material for selective radiative cooling systems.

A further object of the invention is to provide a selective radiative cooling material which is reflective at wavelengths longer than 13 microns.

A still further object of the invention is to provide a selective radiation cooling material which is non-absorptive at wavelengths shorter than 8 microns (radiation scattering is permissible), absorptive from 8 to 13 microns, and reflective at wavelengths longer than 13 microns.

Another object of the invention is to provide a material for selective radiative cooling, which is reflective at wavelengths over 13 microns and consisting of a reflective substrate or coating which is coated with magnesium oxide and/or lithium fluoride.

Another object of the invention is to provide a selective radiative cooling material consisting of a metallic substrate coated with MgO in a ceramic form and or LiF in a polycrystalline form.

Other objects of the invention will become readily apparent from the following description and the accompanying drawings.

SUMMARY OF THE INVENTION

The above objects and advantages of the present invention are accomplished by providing a selective radiation cooling material which is absorptive only in the 8–13 microns wavelength range. This is accomplished by placing magnesium oxide in a ceramic form and/or lithium fluoride in polycrystalline form on an infrared-reflective substrate. The reflecting substrate may be a metallic coating, foil or sheet, such as aluminum, which reflects all atmospheric radiation from 0.3 to 8 microns, the magnesium oxide and lithium fluoride being non-absorptive at those wavelengths. The presence of a certain percentage (<10%) of submicron voids in the material is quite permissible, in which case the MgO and/or LiF layer is diffusely scattering, but still non-absorbing, in the wavelength range of 0.3 to 8 microns. At wavelengths from 8 to 13 microns, the magnesium oxide and lithium fluoride radiate power through the "window" in the atmosphere, and thus remove heat from the reflecting sheet of material and the attached object to be cooled. At wavelengths longer than 13 microns, the magnesium oxide and lithium fluoride reflects the atmospheric radiation back into the atmosphere. This region of high reflectance is only obtained if the surface is sufficiently smooth: roughness on a scale of 1 micron is permissible but roughness on a scale of 10 microns is not. An infrared-transmitting cover or shield is mounted in spaced relationship to the material to reduce convective heat transfer. If the selective radiative cooling material is to be utilized in direct sunlight, the infrared transmitting cover or shield should be opaque in the solar specturm of 0.3 to 3 microns. The previously-referenced patent to Silvestrini et al gives information for the fabrication of such shields.

DESCRIPTION OF THE INVENTION

It is well known that the predominate gases of the air: nitrogen, oxygen, water vapor, and carbon dioxide, have no absorption resonances in the wavelength band from about 8 to 13 microns. Therefore, an ideal thermal radiative cooling system would be one which emits radiation between a wavelength of 8 and 13 microns and reflects all atmospheric radiation having wavelengths outside this waveband. Some materials are transparent or at least non-absorptive to the shorter wavelengths (0.3 to 8 microns), and such radiation passing through them is reflected back into the atmosphere by a reflective substrate. However, most materials that absorb radiation at wavelengths between 8 and 13 microns also have some absorption at longer wavelengths (13–40 microns). Two materials that are the exception to this rule are lithium fluoride (LiF) and magnesium oxide (MgO), both of which are reflective at wavelengths longer than 13 microns.

Accordingly, the present invention involves a thermally selective radiative cooling system utilizing an infrared-reflective substrate coated with MgO and/or LiF in a dense polycrystalline form (voids less than 10% by volume). The infrared-reflective substrate inhibits absorption at wavelengths shorter than 8 micron. The MgO or LiF polycrystalline layers reflect radiation at wavelengths longer than 13 microns. Thus, MgO and LiF are transparent or at least non-absorptive at short wavelengths, absorptive at wavelengths from 8 to 13 microns, and reflective at longer wavelengths.

The advantage of MgO and LiF in the fabrication of good selective radiative cooling systems or radiators lies in the fact that layers of the MgO and LiF can be made quite emissive in the 8 to 13 micron range in sufficient thicknesses and that they change from emissive to reflective behavior at 13 microns.

While both MgO and LiF have been found to be effective selective radiation cooling materials when secured to an infrared-reflective substrate, various methods of fabricating same have been developed. It has been found that fabrication of the thermally selective radiator using powdered layers of MgO and LiF resting on an infrared-reflective substrate, resulted in radiators which were not spectrally selective. Another fabrication technique using MgO and LiF, found not to be fully satisfactory, was to use particles of a size greater than 30 microns, mechanically bonded or merely placed on a supporting reflective substrate, or even to imbed the particles in a matrix of polyethylene other infrared-transparent material. However, to use MgO or LiF in the form of a polycrystalline plate on a reflective substrate, has been found to be most successful.

Figure 1:
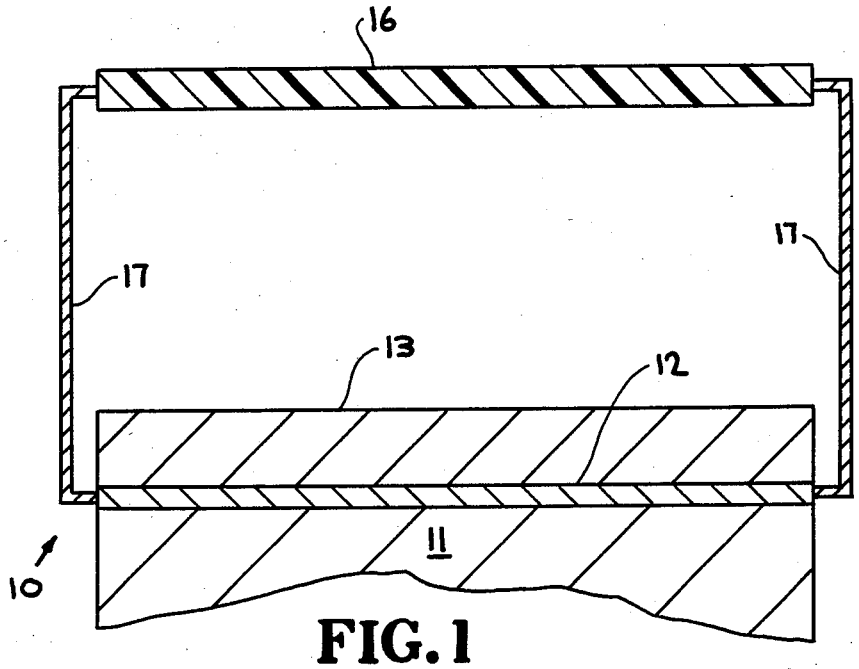
FIG. 1 illustrates an embodiment of the selective radiative cooling material and spaced shielding means made in accordance with the invention secured to a member to be cooled.
Figure 2:
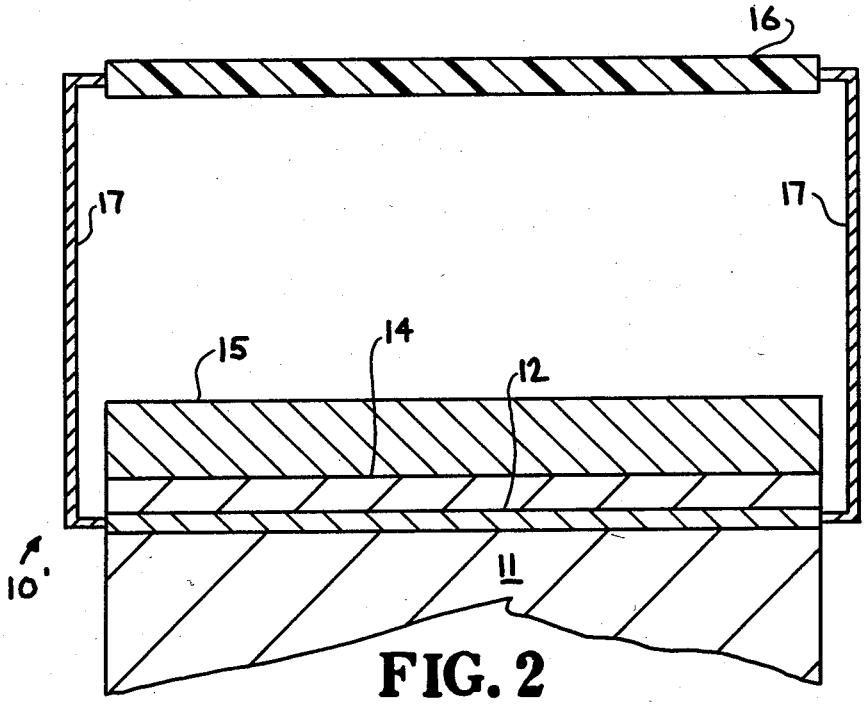
FIG. 2 illustrates another embodiment of the material of the invention.

Referring now to the drawings, FIG. 1 illustrates an embodiment of the selective radiation cooling material (radiator), generally indicated at 10, secured or located on a member or device 11 to be cooled. The material 10 consists of a reflective metallic substrate 12, such as aluminum, which may be a coating, foil or sheet, and a layer 13 of MgO or LiF, or a mixture thereof, in polycrystalline form. The FIG. 2 embodiment is similar to that of FIG. 1 except the material 10' consists of a reflective metallic substrate 12 having secured thereto or located thereon a layer 14 of LiF and a layer 15 of MgO, each layer being in polycrystalline form. The composition of the layers 14 and 15 may be interchanged. The embodiments illustrated in FIGS. 1 amd 2 may utilize a convection barrier constituting a cover, windscreen, shield or venetian blind arrangement 16 mounted in spaced relation to the MgO or LiF polycrystalline layer. The arrangement 16 functions to reduce convective heat transfer from the air to the radiator. For example, the cover or shield 16 may consist of a 50 micron polyethylene film mounted 2.5 centimeters above the radiator, which has an area of 0.5 meter. The cover 16 may be secured by any support means, indicated schematically at 17, which does not interfere with the function of the radiator.

The layer or coating 13 of material 10 consists of MgO, LiF or a mixture thereof, in polycrystalline form, produced by the following technique:

For a pure MgO plate, MgO powder with a particle size less than about 5 microns is heated in a hot press to 1600° C. at 2000 psi. The use of LiF as a 2% additive has virtually no influence on its radiative properties, but permits sufficient densification of the MgO at only 800° C. Pure LiF can be melted at 845° C. and cast into plates. It is not necessary to compress these materials to transparency. It is estimated that density of more than 90% of bulk is adequate if the remaining voids are micron-sized or smaller. It is necessary to ensure that the exposed radiating surface is sufficiently smooth to permit high reflectivity for wavelengths beyond 13 microns. If the pressing operation does not produce a sufficiently smooth surface, it should be further polished with a mechanical abrasive.

The thus formed ceramic coating or layer 13 having a thickness of $1.1 \pm 0.3$ mm, is secured to the substrate 12 by small adhesive dots or by mechanical pressure. The substrate 12 may consist of a coating, sheet or layer of aluminum, copper, or zinc, for example, with a thickness of at least 0.1 microns. In applications where the infrared-reflective substrate is in the form of a metallic coating, mechanical strength would be provided by the MgO and/or LiF layer. Also, the metallic substrate is not limited to the above-identified exemplary materials, since most metals could be used, excepting stainless steel and oxidized or impure metals. For example, with the substrate 12 being of aluminum and having a thickness of 10 microns, the layer or coating 13 of MgO in ceramic form would have a thickness of 1.1 millimeters. A corresponding coating or layer of LiF would have a thickness of 0.54 millimeters. Of course, various combinations of the two materials are possible, in which case the thickness would have to be adjusted accordingly. For example, with a mixture of 50% MgO and 50% LiF, the thickness would be about 0.8 mm, while a 70% MgO-30% LiF mixture would result in a thickness of about 0.9 mm. The metallic substrate may be replaced by a thin evaporated metal coating or layer of aluminum or other metal coating deposited directly on the MgO and/or LiF radiator.

With the material 10 formed as described above, it is secured or positioned on a member or device 11 to be cooled, as known in the art. For example, it may be secured to the device 11 by an adhesive or mechanical pressure. In a simple passive cooling experiment conducted using the selective radiation cooling material of this invention, wherein a 1.1 mm thick MgO ceramic layer, polished on the topside and backed with a metal (aluminum) foil, the MgO radiator reached 22° C. below air temperature, 3° C. colder than a highly emissive non-selective radiator. Attention is directed to the paper "Radiative Cooling With MgO And/Or LiF Layers, P. Berdahl, *Applied Optics* 23, 370–372, 1984, for further information relative to testing carried out to verify the invention.

It has thus been shown that the present invention provides a substantial advance in the field of radiative cooling by providing a selective radiative cooling material comprising an infrared-reflective substrate coated with lithium fluoride in a polycrystalline form and/or magnesium oxide in a ceramic form. The infrared-reflective substrate inhibits absorption at wavelengths shorter than 8 microns with the coating being transparent or at least non-absorptive at these short wavelengths, while the coating reflects radiation at wavelengths longer than 13 microns, and is absorptive from 8 to 13 microns.

While particular embodiments, fabrication processes, parameters, materials, etc., have been described or illustrated, such are not considered to be exhaustive or limiting and modifications will become apparent to those skilled in the art, and it is intended to cover in the appended claims all such modifications as come within the scope of the invention.

What is claimed is:

1. A selective radiative cooling material consisting of:
an infrared-reflective substrate, and
at least one layer of material selected from the group consisting of ceramic magnesium oxide, polycrystalline lithium fluoride, and mixtures thereof.

2. The selective radiative cooling material of claim 1, wherein said infrared-reflective substrate consists of metallic material selected from the group consisting of aluminum, copper, and zinc.

3. The selective radiative cooling material of claim 2, wherein said layer of material consists of magnesium oxide in a ceramic form, and wherein said infrared-reflective substrate consists of aluminum.

4. The selective radiative cooling material of claim 3, wherein said layer of material has a thickness of about 1.1 millimeters.

5. The selective radiative cooling material of claim 1, wherein said layer of material consists of polycrystalline lithium fluoride having a thickness of about 0.54 millimeters.

6. The selective radiative cooling material of claim 1, additionally includes a means mounted in spaced relation to said layer of material for eliminating convective heat transfer.

7. The selective radiative cooling material of claim 6, wherein said means includes a layer of infrared-transmitting material mounted in spaced relation to said layer of radiating material.

8. The selective radiative cooling material of claim 7, wherein said infrared-transmitting material consists of a polyethylene film.

9. A selective radiative cooling material consisting of:
an infrared-reflective substrate, and
layers of material consisting of a layer of magnesium oxide in a ceramic form and a layer of lithium fluoride in a polycrystalline form.

10. The selective radiative cooling material of claim 9, additionally including means mounted in spaced relation to said layers of material for eliminating convective heat transfer.

11. The selective radiative cooling material of claim 10, wherein said means includes a layer of infrared-transmitting material mounted in spaced relation to said layers of material.

12. The selective radiative cooling material of claim 11, wherein said infrared-transmitting material consists of a polyethylene film.

13. In a thermally selective radiative cooling system, the improvement comprising a selective radiative cooling material, said material consisting of:
an infrared-reflective substrate which inhibits absorption at wavelengths shorter than about 8 microns, said substrate consisting of a metallic layer selected from the group consisting of aluminum, copper and zinc, and
at least one layer of material which is at least non-absorptive, if not transparent, at wavelengths shorter than about 8 microns, absorptive at wavelengths from about 8–13 microns, and reflective at wavelengths longer than about 13 microns, said at least one layer of material being selected from the group consisting of ceramic magnesium oxide, polycrystalline lithium fluoride, and mixtures thereof.

14. The improvement of claim 13, wherein said substrate is of aluminum, and wherein said material consists of a layer of ceramic magnesium oxide.

15. The improvement of claim 13, additionally including means for eliminating convective heat transfer to said selective radiative cooling material.

16. The improvement of claim 15, wherein said means includes a film of infrared-transparent material located in spaced relation to said layer of radiative cooling material.

17. The improvement of claim 16, wherein said film of infrared-transparent material consists of polyethylene having a thickness of about 50 microns.

18. A thermally selective radiative cooling system comprising:

a device to be cooled, a selective radiative cooling means mounted on said device to be cooled, said means being constructed of material which inhibits absorption at wavelengths shorter than about 8 microns, is absorptive at wavelengths from about 8 to 13 microns, and reflects radiation at wavelengths longer than about 13 microns, said material consisting of a layer of infrared-reflective material, and at least one layer of material selected from the group consisting of magnesium oxide in a ceramic form, lithium fluoride in a polycrystalline form, and mixtures thereof, and a convection barrier positioned in spaced relation to said selective radiative cooling means.

19. The system of claim 18, wherein said infrared reflective material consists of a metallic layer selected from the group consisting of aluminum, copper, and zinc.

20. The system of claim 18, wherein said convection barrier comprises means for reducing convective heat transfer, said means includes an infrared-transmitting cover positioned in spaced relation to said selective radiative cooling means.

21. The system of claim 18, wherein said selective radiative cooling means consists of an aluminum substrate and a layer of magnesium oxide in ceramic form.

* * * * *